US008742988B2

(12) United States Patent
Oishi

(10) Patent No.: US 8,742,988 B2
(45) Date of Patent: Jun. 3, 2014

(54) ANTENNA AND PORTABLE APPARATUS

(75) Inventor: Sadatoshi Oishi, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 381 days.

(21) Appl. No.: 13/027,745

(22) Filed: Feb. 15, 2011

(65) Prior Publication Data

US 2011/0199277 A1 Aug. 18, 2011

(30) Foreign Application Priority Data

Feb. 16, 2010 (JP) ..... 2010-031628

(51) Int. Cl.
*H01Q 1/38* (2006.01)
*H01Q 1/50* (2006.01)
*H01Q 1/48* (2006.01)

(52) U.S. Cl.
USPC ..... 343/700 MS; 343/848; 343/906

(58) Field of Classification Search
CPC ..... G01S 13/825; G06K 7/10881; G06K 19/07743; G06K 7/10386; H01Q 1/2216
USPC ..... 343/848, 882, 881, 871, 906, 700 MS
See application file for complete search history.

(56) References Cited

U.S. PATENT DOCUMENTS 5,055,852 A * 10/1991 Dusseux et al. ..... 343/725
2004/0021606 A1 2/2004 Shigihara
2004/0069851 A1* 4/2004 Grunes et al. ..... 235/435
2005/0239519 A1 10/2005 Saitou et al.
2009/0312053 A1* 12/2009 An ..... 455/556.2
2010/0045541 A1* 2/2010 Aoki et al. ..... 343/702
2011/0080327 A1* 4/2011 Kobayashi et al. ..... 343/702
2011/0163936 A1* 7/2011 Schneider et al. ..... 343/893

FOREIGN PATENT DOCUMENTS

JP 58-166105 11/1983
JP 01-290301 11/1989
JP 06-021715 1/1994
JP 11-027024 1/1999
JP 2008199113 8/2008
WO PCT/JP2009/000703 * 2/2009 ..... 343/702

OTHER PUBLICATIONS

Rick Desloge, Catching Waves—St. Louis Business Journal, Apr. 27, 2008. pp. 1-3.*
Wong et al. (Printed Ring Slot Antenna for Circular Polarization, IEEE Transactions on Antennas and Propagation, vol. 50, No. 1, Jan. 2002. pp. 75-77).*

(Continued)

*Primary Examiner* — Dameon Levi
*Assistant Examiner* — Ricardo Magallanes
(74) *Attorney, Agent, or Firm* — Amin, Turocy & Watson, LLP

(57) ABSTRACT

According to one embodiment, an antenna mounted on a portable apparatus having a hinge structure includes: a radiating element formed in a disk shape and configured to radiate a radio wave; a power feeding element exciting the radiating element; and a ground plate including a bottom surface arranged in parallel to the radiating element and the power feeding element and a side surface configured to allow a power feeding path feeding electric power to the power feeding element to pass in an area different from an area opposed to the hinge structure.

7 Claims, 7 Drawing Sheets

(56) References Cited

OTHER PUBLICATIONS

IEEE Transactions on Antennas and Propagation, Guo, Yong-Xin, et al. "Broadband Circularly Polarized Annular-Ring Microstrip Antenna", Aug. 2009, vol. 57, No. 8.

IEEE Transactions on Antennas and Propagation, Guo, Yong-Xin, et al., "L-Probe Proximity-Fed Annular Ring Microstrip Antennas", Jan. 2001, vol. 49, No. 1.

Baek, Seung Hoon, et al., "Modified aperture coupling annular-ring antenna fed by stripline", IEEE, 2007, pp. 3680-3683.

Duffy, Sean M., et al., "A Modified Transmission Line Model for Cavity Backed Microstrip Antennas", IEEE Antennas and Propagation Society International Symposium 1997, Digest vol. 1, pp. 2139-2142.

Office Action of First Notification of the Examiner's Opinion for Chinese Patent Application No. 201110038653.5 dated Apr. 3, 2013, 8 pgs.

* cited by examiner

ANTENNA AND PORTABLE APPARATUS

CROSS-REFERENCE TO RELATED APPLICATION

This application is also based upon and claims the benefit of priority from Japanese Patent Application No, 2010-31628, filed on Feb. 16, 2010; the entire contents of which are incorporated herein by reference.

FIELD

Embodiments described herein relate generally to a planar antenna used in a portable RFID (Radio Frequency Identification) reader writer or the like.

BACKGROUND

There is a structure in which a power feeding unit (a coaxial connector) is provided on the rear surface of an antenna. There is also a structure in which a power feeding unit is provided on a side surface of an antenna.

When it is attempted to mount an antenna on a portable apparatus including a hinge structure, if a power feeding unit for the antenna is present in a position where the power feeding unit interferes with the hinge structure, the portable apparatus is increased in size. In order to reduce the size of the portable apparatus, it is necessary to prevent the interference between the power feeding unit and the hinge structure.

DETAILED DESCRIPTION

In general, according to one embodiment, an antenna mounted on a portable apparatus having a hinge structure includes: a radiating element formed in a disk shape and configured to radiate a radio wave; a power feeding element configured to excite the radiating element; and a ground plate that supports the radiating element and the power feeding element and on which a power feeding path feeding electric power to the power feeding element passes in an area different from an area opposed to the hinge structure among sidewalls adjacent to the hinge structure.

Figure 1:
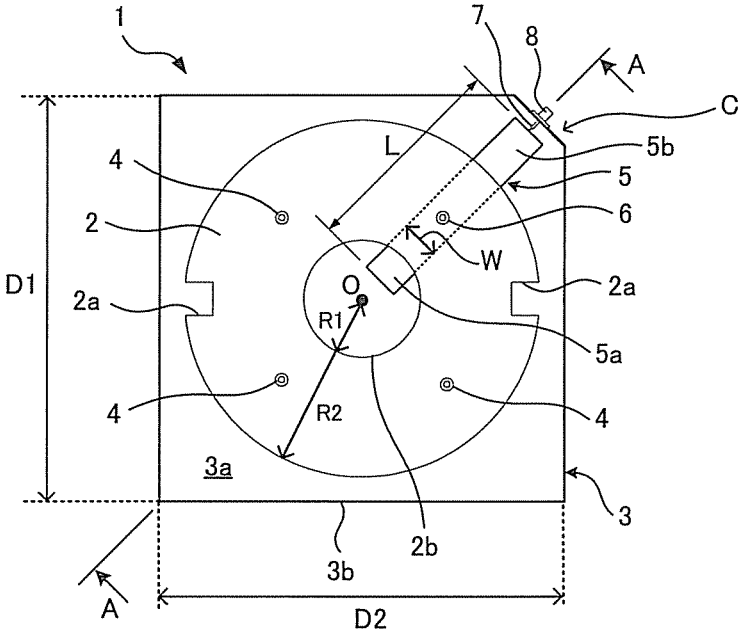
FIG. 1 is a front view of a patch antenna.
Figure 2:
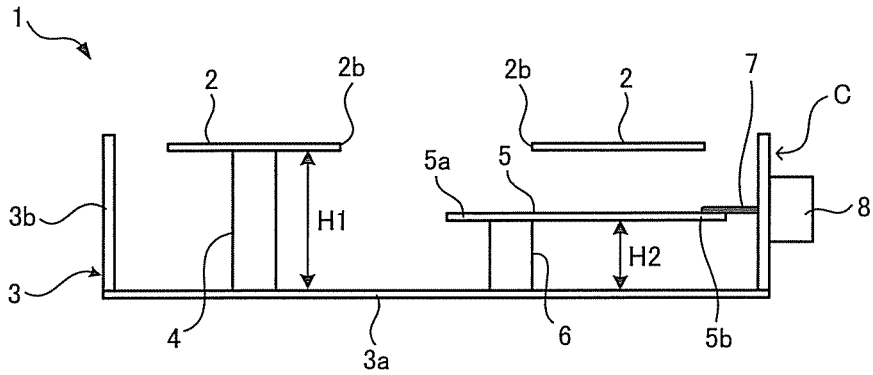
FIG. 2 is a sectional view taken along line A-A in FIG. 1 in the patch antenna.

An embodiment is explained below with reference to the accompanying drawings. FIG. 1 is a diagram of a patch antenna according to this embodiment viewed from the front of the patch antenna. FIG. 2 is a sectional view taken along line A-A in FIG. 1.

A patch antenna 1 includes a tabular radiating element 2. The radiating element 2 is formed in a substantially circular shape when viewed from the front of the patch antenna 1. A direction orthogonal to a surface (an imaginary surface) on which the radiating element 2 is located is a direction corresponding to the front of the patch antenna 1.

Two cutouts 2*a* are formed in the outer circumferential section (the outer edge section) of the radiating element 2. The outer circumferential section of the radiating element 2 excluding the cutouts 2*a* is formed along a circle. Although the cutouts 2*a* are formed in this embodiment, the cutouts 2*a* do not have to be formed. In other words, the radiating element 2 can be formed in a circular shape.

When the patch antenna 1 is viewed from the front, an opening 2*b* is formed in the center (an area including a center point O) of the radiating element 2. The two cutouts 2*a* are provided in positions opposed to each other across the opening 2*b*.

In this embodiment, when the patch antenna 1 is viewed from the front, the radiating element 2 is formed in a substantially circular shape. However, the radiating element 2 can be formed in other shapes. For example, the radiating element 2 can be formed in a regular polygonal shape.

The radiating element 2 is held by a ground plate 3. As shown in FIG. 2, ribs 4 pierce through a bottom surface 3*a* of the ground plate 3. The ribs 4 extend in a direction orthogonal to the bottom surface 3*a*. The radiating element 2 is fixed to the distal ends of the ribs 4. In this embodiment, as shown in FIG. 1, the radiating element 2 is supported by three ribs 4.

When the patch antenna 1 is viewed from the front, two ribs 4 are arranged in positions opposed to each other across the opening 2*b* of the radiating element 2. Another rib 4 is arranged between the two ribs 4 in the circumferential direction of the radiating element 2. The three ribs 4 are arranged on a track of a circle centered on the point O. Since the three ribs 4 are arranged, it is possible to stably support the radiating element 2.

The number and the positions of the ribs 4 for supporting the radiating element 2 can be set as appropriate. Specifically, the radiating element 2 only has to be able to be supported using the ribs 4. The number of the ribs 4 and positions where the ribs 4 are arranged can be set as appropriate.

Figure 3A:
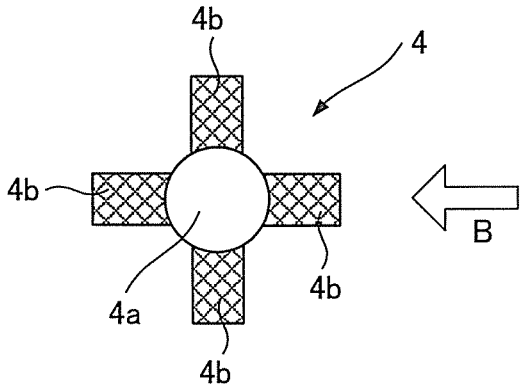
FIG. 3A is a front view of the structure of a rib.
Figure 3B:
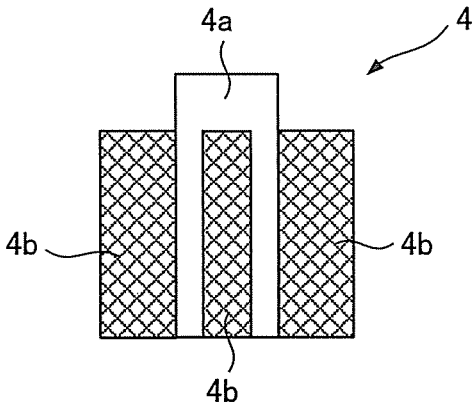
FIG. 3B is a side view of the structure of the rib.

A supporting structure for the radiating element 2 by the ribs 4 is specifically explained with reference to FIGS. 3A and 3B. FIG. 3A is a front view of the rib 4 viewed from the front of the patch antenna 1. FIG. 3B is a side view of the rib 4 viewed from a direction of an arrow B shown in FIG. 3A.

The rib 4 includes a main body 4*a* formed in a columnar shape and four blades 4*b* provided on the outer circumferential surface of the main body 4*a*. The four blades 4*b* are arranged at equal intervals in the circumferential direction of the main body 4*a*. Although the four blades 4*b* are provided in this embodiment, the number of the blades 4*b* can be set as appropriate.

As shown in FIG. 3B, an area where the blades 4*b* are not provided is formed at one end of the main body 4*a*. The one end of the main body 4*a* is inserted into an opening (not shown) formed in the radiating element 2. Since the one end of the main body 4*a* is inserted into the opening of the radiating element 2, it is possible to position the radiating element 2 in a direction orthogonal to a longitudinal direction of the main body 4*a*. Since the radiating element 2 is set in contact with one ends of the blades 4*b*, it is possible to position the radiating element 2 in the longitudinal direction of the main body 4*a*.

The radiating element 2 is arranged substantially in parallel to the bottom surface 3*a* of the ground plate 3 by the ribs 4. As shown in FIG. 2, a space between the radiating element 2 and the bottom surface 3*a* is set to be a predetermined value H1.

A tabular power feeding element 5 is arranged between the radiating element 2 and the bottom surface 3*a* of the ground plate 3. The power feeding element 5 is supported by a rib 6. The rib 6 extends in the direction substantially orthogonal to the bottom surface 3*a* of the ground plate 3. The power feeding element 5 is fixed to the distal end of the rib 6.

A supporting structure for the power feeding element 5 by the rib 6 is the same as the supporting structure for the radiating element 2 by the ribs 4 (FIGS. 3A and 3B). Specifically, since one end of the rib 6 is inserted into a hole formed in the power feeding element 5, it is possible to position the power feeding element 5 in a plane orthogonal to a longitudinal direction of the rib 6. Since a part of the rib 6 (equivalent to the blades 4*b*) is set in contact with the power feeding element 5, it is possible to position the power feeding element 5 in the longitudinal direction of the rib 6.

The power feeding element 5 is arranged substantially in parallel to the bottom surface 3*a* of the ground plate 3 by the rib 6. In other words, the power feeding element 5 and the radiating element 2 are arranged substantially in parallel to each other. As shown in FIG. 2, a space between the power feeding element 5 and the bottom surface 3*a* is set to be a predetermined value H2.

In this embodiment, the power feeding element 5 is supported by one rib 6. However, the power feeding element 5 can also be supported by plural ribs 6. The number of the ribs 6 and positions where the ribs 6 are arranged can be set as appropriate taking into account the supporting of the power feeding element 5.

As shown in FIG. 1, when the patch antenna 1 is viewed from the front, the power feeding element 5 has length L and width W. The width W is smaller than the length L. The width W is smaller than the diameter of the opening 2*b* in the radiating element 2. The space H2, the width W, and the length L can be set according to the impedance of the patch antenna 1.

Figure 4:
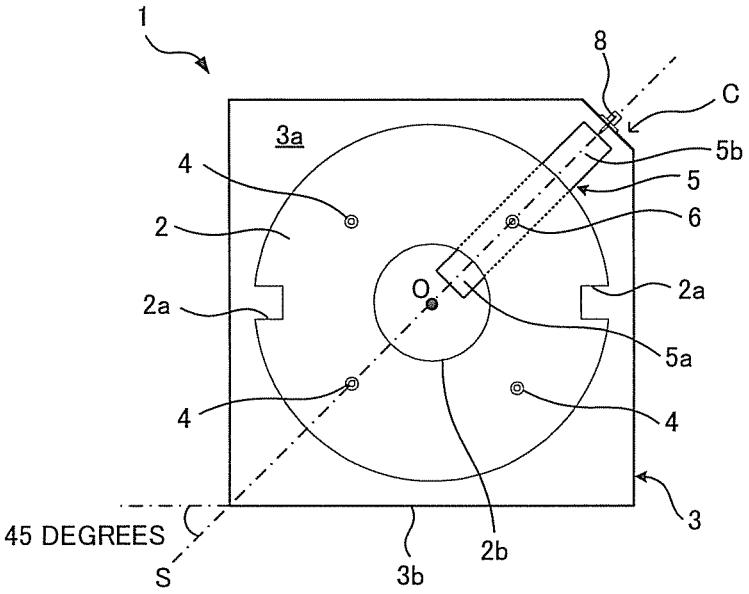
FIG. 4 is a diagram for explaining the arrangement of a power feeding element in the patch antenna.

In this embodiment, the power feeding element 5 is arranged such that a longitudinal direction (a longitudinal axis) of the power feeding element 5 is along a radial direction of the radiating element 2. Specifically, as shown in FIG. 4, the power feeding element 5 is arranged such that a longitudinal axis S of the power feeding element 5 tilts about 45 degrees with respect to side surfaces 3*b* of the ground plate 3 (excluding an area where a power feeding connector 8 is arranged). In this embodiment, when the patch antenna 1 is viewed from the front, since the side surfaces 3*b* (excluding an arrangement area of the power feeding connector 8) are formed along a rectangle, the longitudinal axis S of the power feeding element 5 tilts about 45 degrees with respect to all the side surfaces 3*b*.

When the patch antenna 1 is viewed from the front, one end 5*a* of the power feeding element 5 is located on an inner side of the opening 2*b*. The other end 5*b* of the power feeding element 5 is connected to the power feeding connector 8 via a wire 7. The power feeding connector 8 is connected to a reader writer (not shown). Electric power from the reader writer is supplied to the power feeding element 5.

The power feeding connector 8 is fixed on the side surfaces 3*b* of the ground plate 3. Specifically, the power feeding connector 8 is attached to a surface on the outer side of the ground plate 3 among the side surfaces 3*b*. As shown in FIG. 1, dimensions of the ground plate 3 are set to D1×D2. In this embodiment, although the dimension D1 and the dimension D2 are same, the dimension D1 and the dimension D2 may be set different from each other.

When the patch antenna 1 is viewed from the front, the power feeding connector 8 is arranged at a corner C of the side surfaces 3*b*. The corner C of the side surfaces 3*b* has a planar section for attaching the power feeding connector 8. The side surfaces 3*b* are formed along the outer edge of the bottom surface 3*a* and extend in the direction substantially orthogonal to the bottom surface 3*a*. When the patch antenna 1 is viewed from the front, the side surfaces 3*b* are arranged in positions surrounding the radiating element 2.

Since the electric power is supplied to the power feeding element 5, it is possible to excite the radiating element 2 and generate a circularly polarized wave in the patch antenna 1. Since the cutouts 2*a* are provided in the outer circumferential section of the radiating element 2, it is possible to generate a circularly polarized wave. When a linearly polarized wave is generated, the cutouts 2*a* only have to be omitted. In other words, when the patch antenna 1 is viewed from the front, the radiating element 2 only has to be formed in a circular shape.

In the patch antenna 1 according to this embodiment, in order to reduce the patch antenna 1 in size, the opening 2*b* is provided in the radiating element 2. As a radius R1 (see FIG. 1) of the opening 2*b* is set larger, it is possible to set a resonance frequency of the radiating element 2 lower. It is possible to suppress the oscillation amplitude of the radiating element 2 and reduce the patch antenna 1 including the radiating element 2 in size. On the other hand, as the radius R1 of the opening 2*b* is set larger, the band width of the patch antenna 1 is narrower. It is possible to set the size (the radius R1) of the opening 2*b* taking into account an application of the patch antenna 1 and external dimensions (D1×D2) required of the patch antenna 1.

For example, when the patch antenna 1 is used in a 953 MHz band, if the external dimensions (D1×D2 shown in FIG. 1) of the ground plate 3 is set to 160×160 [mm] and the radius (R2 shown in FIG. 1) of the radiating element 2 is set to 140 [mm], the radius (R1 shown in FIG. 1) of the opening 2*b* only has to be set to about 56 mm.

The structure of a portable reader writer including the patch antenna 1 explained above is explained with reference to FIGS. 5 to 7.

Figure 5:
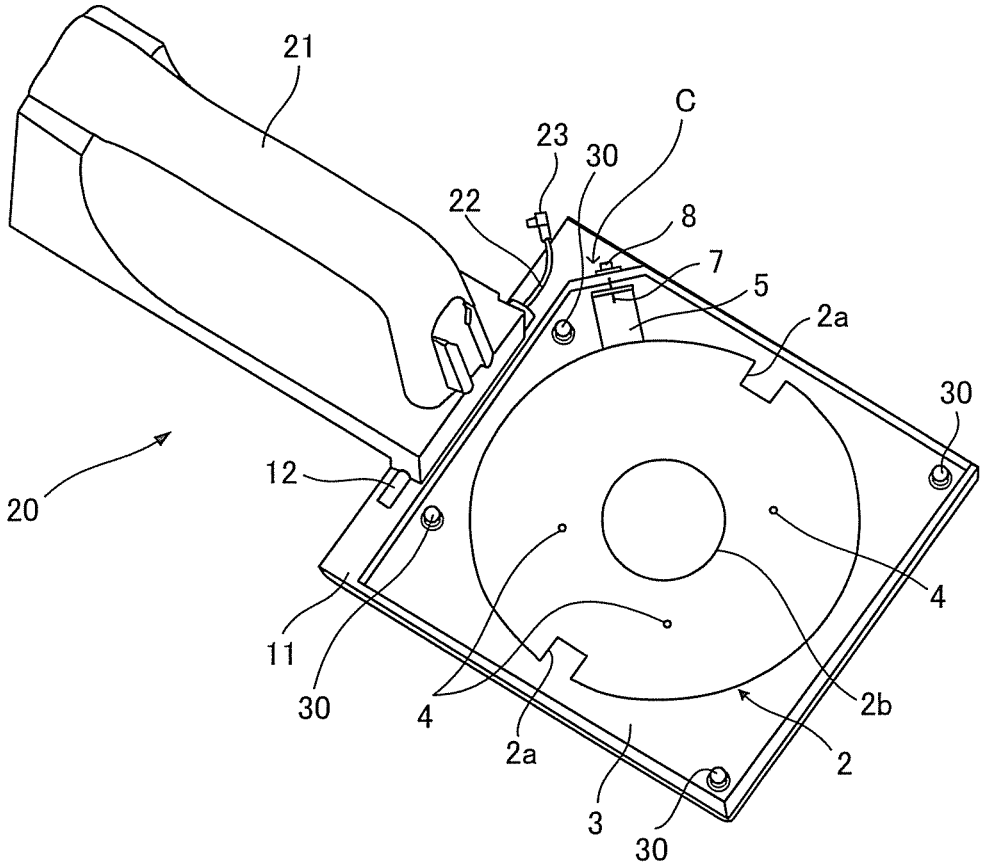
FIG. 5 is an external view of a portable reader writer.
Figure 6:
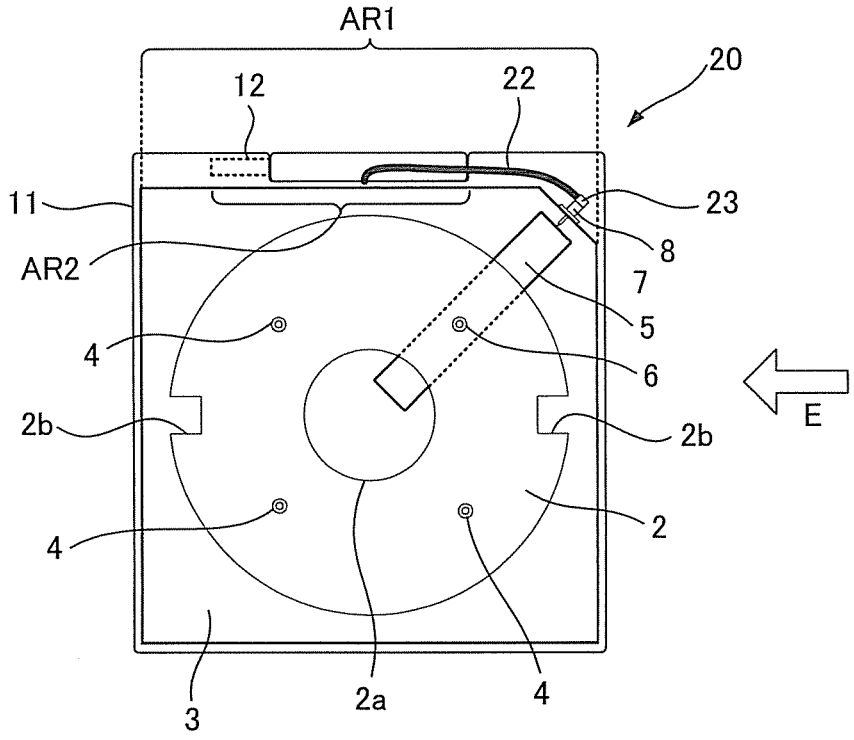
FIG. 6 is a front view of the portable reader writer in a folded state.
Figure 7:
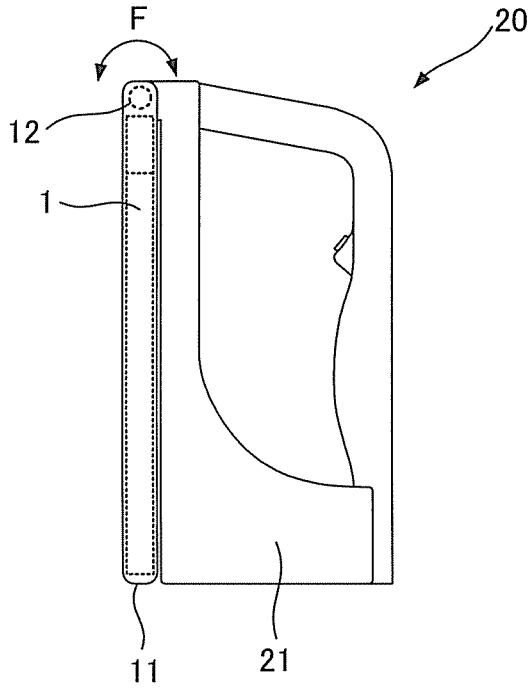
FIG. 7 is a diagram of the portable reader writer viewed from a direction of an arrow E shown in FIG. 6.

FIG. 5 is an external view of an internal structure of the portable reader writer. Specifically, FIG. 5 is a diagram of the structure of the portable reader writer in a state in which a part of a cover is removed. In FIGS. 6 and 7, a state in which the portable reader writer is folded is shown. FIG. 6 is a diagram of the portable reader writer viewed from the side of the patch antenna 1. FIG. 7 is a diagram of the portable reader writer viewed from a direction of an arrow E shown in FIG. 6.

The patch antenna 1 having the configuration explained above is fixed to a cover 11. The cover 11 covers the patch antenna 1. In FIG. 5, a part of the cover 11 is shown. Specifically, the cover 11 includes two covers (a lower cover and an upper cover) fixed to each other. In FIG. 5, only one cover (the lower cover) is shown.

As shown in FIG. 5, plural positioning pins 30 are provided in the cover 11. The positioning pins 30 pierce through the bottom surface 3*a* of the ground plate 3. Since the positioning pins 30 pierce through the bottom surface 3*a* of the ground plate 3, it is possible to fix the patch antenna 1 to the cover 11. In the cover 11, the ribs 4 and 6 explained with reference to FIGS. 1 and 2 are provided. The cover (the lower cover) 11 is formed along the ground plate 3 of the patch antenna 1. An upper cover (not shown) is fixed by bolts (not shown) to the cover (the lower cover) 11 to which the patch antenna 1 is fixed.

A portable reader writer 20 includes a main body 21. The main body 21 has a function of a grip and also has a function of controlling the operation of the patch antenna 1. The main body 21 is attached to the cover (the lower cover) 11 to be capable of rotating in a direction of an arrow F shown in FIG. 7. Specifically, a shaft 12 is attached to the cover (the lower cover) 11. The main body 21 is attached to the shaft 12 to be capable of rotating. Specifically, the cover 11 and the main body 21 are connected by a hinge structure.

If the portable reader writer 20 is folded, as shown in FIG. 7, the cover 11 including the patch antenna 1 and the main body 21 can be arranged to be superimposed one upon another. In other words, a part of the main body 21 can be arranged along the surface of the cover 11.

When the patch antenna 1 is incorporated in the cover 11, the power feeding connector 8 is provided on the side surface 3*b* adjacent to the hinge structure in the ground plate 3. In FIG. 6, the side surface 3*b* adjacent to the hinge structure is shown as an area AR1. The side surface 3*b* equivalent to the area AR1 includes an area AR2 opposed to the hinge structure and an area other than the area AR2. The power feeding connector 8 is provided in the area (including the corner C) other than the area AR2.

A cable (a coaxial cable) 22 connected to the reader writer is arranged on a rotation axis of the main body 21. A connector 23 is provided at an end of the cable 22. The connector 23 is connected to the power feeding connector 8. Since the connector 23 and the power feeding connector 8 are connected, it is possible to feed electric power, which is received from the reader writer, to the power feeding element 5.

In the structure explained in this embodiment, the connector 23 and the power feeding connector 8 are connected. However, the power feeding element 5 and the reader writer can also be connected by one cable. Specifically, a power feeding path for feeding electric power to the power feeding element 5 only has to be configured to pass the area of the corner C shown in FIGS. 1 and 4. As in this embodiment, if the connector 23 and the power feeding connector 8 are used, it is possible to easily attach the patch antenna 1 to the cover 11 and improve manufacturing efficiency of the portable reader writer 20.

According to this embodiment, since the power feeding connector 8 is arranged in the corner C, it is possible to arrange the power feeding connector 8 to prevent interference with the hinge structure while suppressing an increase in the size of the portable reader writer 20. If it is attempted to provide the power feeding connector 8 in the area AR2 shown in FIG. 6, in order to prevent the power feeding connector 8 from interfering with the hinge structure, the portable reader writer 20 has to be increased in size.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A portable apparatus comprising:

an antenna including: a radiating element formed in a disk shape and configured to radiate a radio wave; a power feeding element for exciting the radiating element; and a ground plate including a bottom surface arranged substantially in parallel to the radiating element and the power feeding element and a side surface for allowing a power feeding path for feeding electric power to the power feeding element to pass in an area that is not next to a hinge structure, wherein the ground plate has four side surfaces surrounding the radiating element and the power feeding element when viewed from a direction orthogonal to a plane of the radiating element, and wherein the hinge structure is arranged along one of the side surfaces;

a cover configured to cover the antenna;

a connector forming a part of the power feeding path is arranged at a first corner of two of the four side surfaces, wherein the first corner is inclined to the two side surfaces, and wherein the corner is at an end of a side surface adjacent to the hinge structure and the end of the side surface is positioned at a corner of the ground plate, and wherein the hinge structure is arranged on one of the two side surfaces;

a main body connected to the cover by the hinge structure; and a cable configured to electrically connect the antenna and the main body and passes through the hinge structure, wherein the cable is also attachable and detachable to the connector.

2. The apparatus according to claim 1, wherein the power feeding element is arranged along a radial direction of the radiating element when viewed from a predetermined direction orthogonal to a surface on which the radiating element is located.

3. The apparatus according to claim 1, wherein the ground plate has a side surface formed along a rectangle surrounding the radiating element when viewed from the predetermined direction, and the power feeding element is arranged such that a longitudinal axis of the power feeding element tilts at an angle of 45 degrees with respect to the side surface when viewed from the predetermined direction.

4. The apparatus according to claim 1, wherein the radiating element has an opening in a center area when viewed from a predetermined direction orthogonal to a surface on which the radiating element is located.

5. The apparatus according to claim 1, wherein one end of the power feeding element is present on an inner side of the opening when viewed from the predetermined direction.

6. The apparatus according to claim 1, wherein the opening is formed in a circular shape or a regular polygonal shape when viewed from the predetermined direction.

7. The apparatus according to claim 1, wherein the radiating element has cutouts on an outer circumference when viewed from a predetermined direction orthogonal to a surface on which the radiating element is located.

* * * * *